US007712985B2

(12) United States Patent
Kato et al.

(10) Patent No.: US 7,712,985 B2
(45) Date of Patent: May 11, 2010

(54) PRINT CASSETTE

(75) Inventors: Tsutomu Kato, Nagoya (JP); Mariko Yamada, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 458 days.

(21) Appl. No.: 11/726,876

(22) Filed: Mar. 23, 2007

(65) Prior Publication Data

US 2007/0237562 A1 Oct. 11, 2007

(30) Foreign Application Priority Data

Mar. 29, 2006 (JP) ..... 2006-092077

(51) Int. Cl.
*B41J 35/28* (2006.01)

(52) U.S. Cl. ..... 400/207; 400/241; 156/387

(58) Field of Classification Search ..... 400/207, 400/208, 611, 613, 613.1, 615, 615.2, 241; 156/387, 388, 540, 541, 555

See application file for complete search history.

(56) References Cited

U.S. PATENT DOCUMENTS

| | | | | |
|---|---|---|---|---|
| 4,839,742 | A | 6/1989 | Nakatani et al. | |
| 5,203,951 | A * | 4/1993 | Hattori et al. | 156/554 |
| 5,441,586 | A * | 8/1995 | Fukunaga et al. | 156/387 |
| 6,486,903 | B1 * | 11/2002 | Wagner et al. | 347/212 |
| 2003/0079830 | A1 | 5/2003 | Kuller et al. | |
| 2006/0177618 | A1 * | 8/2006 | Kato et al. | 428/40.1 |

FOREIGN PATENT DOCUMENTS

| | | |
|---|---|---|
| EP | 0 322 919 A2 | 7/1989 |
| EP | 1 403 084 A1 | 3/2004 |
| EP | 1 580 007 A1 | 9/2005 |
| JP | 63125340 | 5/1988 |

* cited by examiner

*Primary Examiner*—Ren Yan
(74) *Attorney, Agent, or Firm*—Day Pitney LLP

(57) ABSTRACT

The lettering tape produced by the print cassette is composed of an application tape and an adhesive tape. The adhesive tape has a release sheet with which an adhesive layer is coated. A printing surface of the application tape to which the ink is thermally transferred and the adhesive layer are overlapped to be stuck to each other to compose the lettering tape retransferring the ink.

18 Claims, 10 Drawing Sheets

PRINT CASSETTE

CROSS-REFERENCE TO RELATED APPLICATIONS

This application claims priority from JP 2006-092077, filed Mar. 29, 2006, the contents of which are hereby incorporated by reference.

TECHNICAL FIELD

The disclosure relates to a print cassette and a lettering tape.

BACKGROUND

Conventionally, a tape printer for producing a simple lettering tape disclosed in Japanese patent application laid-open No. S63(1988)-125340, for instance, has been used to produce the lettering tape to which desired characters and the like are transferred. With regard to the produced lettering tape, the transferred surface thereof is pressed against an object and rubbed thereover, and thus the characters can be retransferred to the object.

However, it is necessary to hard rub the lettering tape with a tool such as a stylus (transferring pen) to retransfer the characters and the like on the transferred surface of the lettering tape to the object.

SUMMARY

The disclosure has been made in view of the above circumstances and has an object to overcome the above problems and to provide a print cassette for producing a lettering tape with which ink can be retransferred to an adherend by a light pressure of fingers and the like.

To achieve the purpose of the disclosure, there is provided a print cassette capable of being installed in a printer, comprising an adhesive tape, an ink ribbon and an application tape inside a cassette case, wherein the adhesive tape, the ink ribbon and the application tape are wound respectively inside the cassette case, and the application tape comprises a printing surface to which ink of the ink ribbon is thermally transferred, and the adhesive tape comprises a release sheet and a adhesive layer, and the adhesive layer is formed with an adhesive coating a first side of the release sheet, and the adhesive is capable of being removed from the release sheet, but incapable of being removed from the application tape and the ink while the first side of the release sheet is adhered to the printing surface of the application tape to which the ink of the ink ribbon has been thermally transferred with the adhesive.

According to another aspect of the disclosure, there is provided a lettering tape comprising an adhesive tape and an application tape, wherein the application tape comprises a printing surface to which ink can be thermally transferred, and the adhesive tape comprises a release sheet and an adhesive layer, and the adhesive layer is formed with an adhesive coating a first side of the release sheet, and the lettering tape is composed of the application tape to which the ink has been thermally transferred and the release sheet of which the first side is stuck to the printing surface of the application tape with the adhesive, and the adhesive is capable of being removed from the release sheet, but incapable of being removed from the application tape and the ink.

DETAILED DESCRIPTION

A detailed description of an exemplary embodiment of a print cassette of the disclosure will now be given referring to the accompanying drawings.

Figure 2:
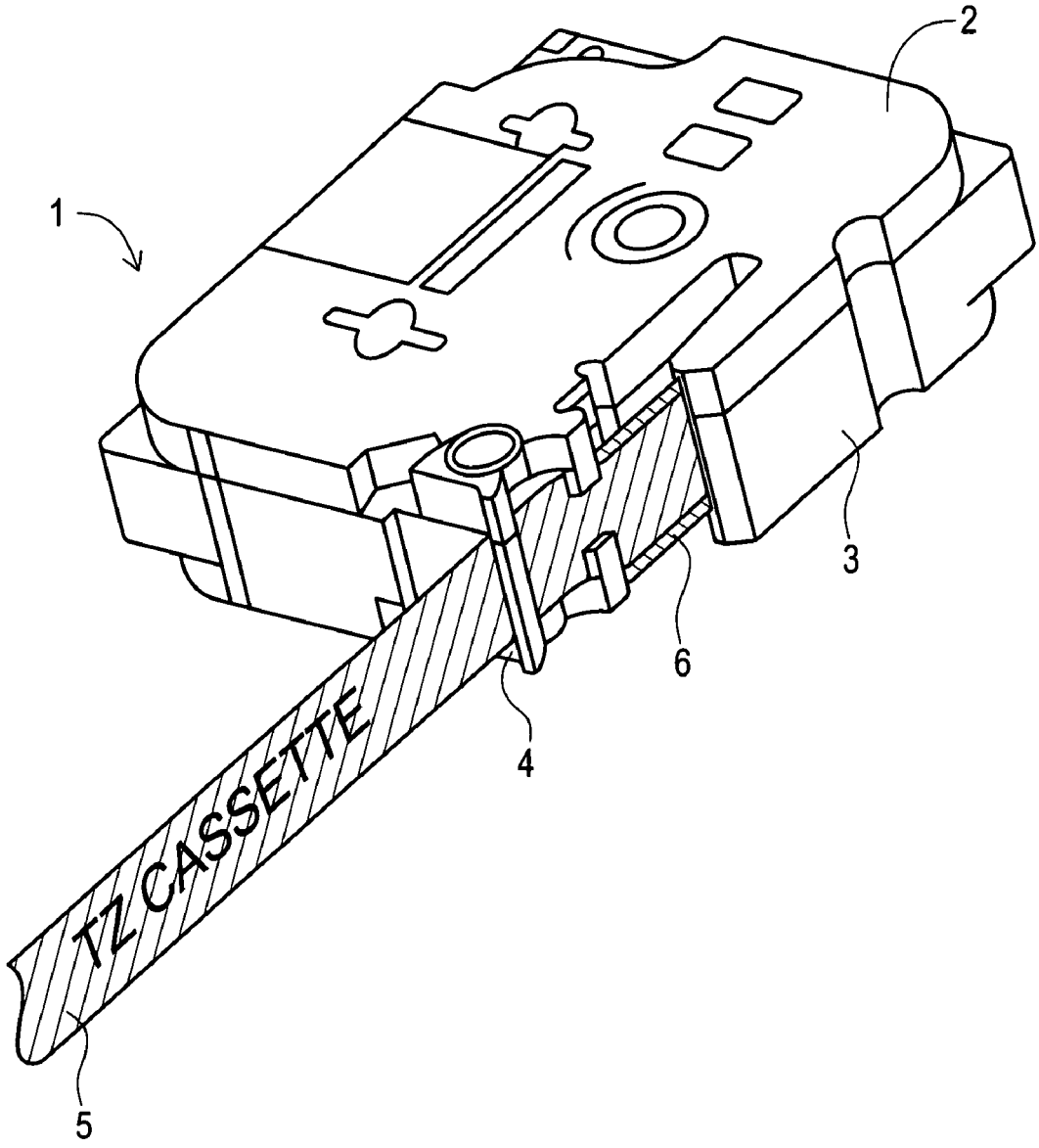
FIG. 2 is a perspective view of a print cassette.

FIG. 2 is a perspective view of a print cassette. As shown in FIG. 2, a print cassette 1 of the exemplary embodiment comprises an upper cassette case 2 and a lower cassette case 3. A lettering tape 5 is discharged from the print cassette 1 through a tape discharging port 4. It is noted that a reference numeral 6 indicates an ink ribbon.

Figure 3:
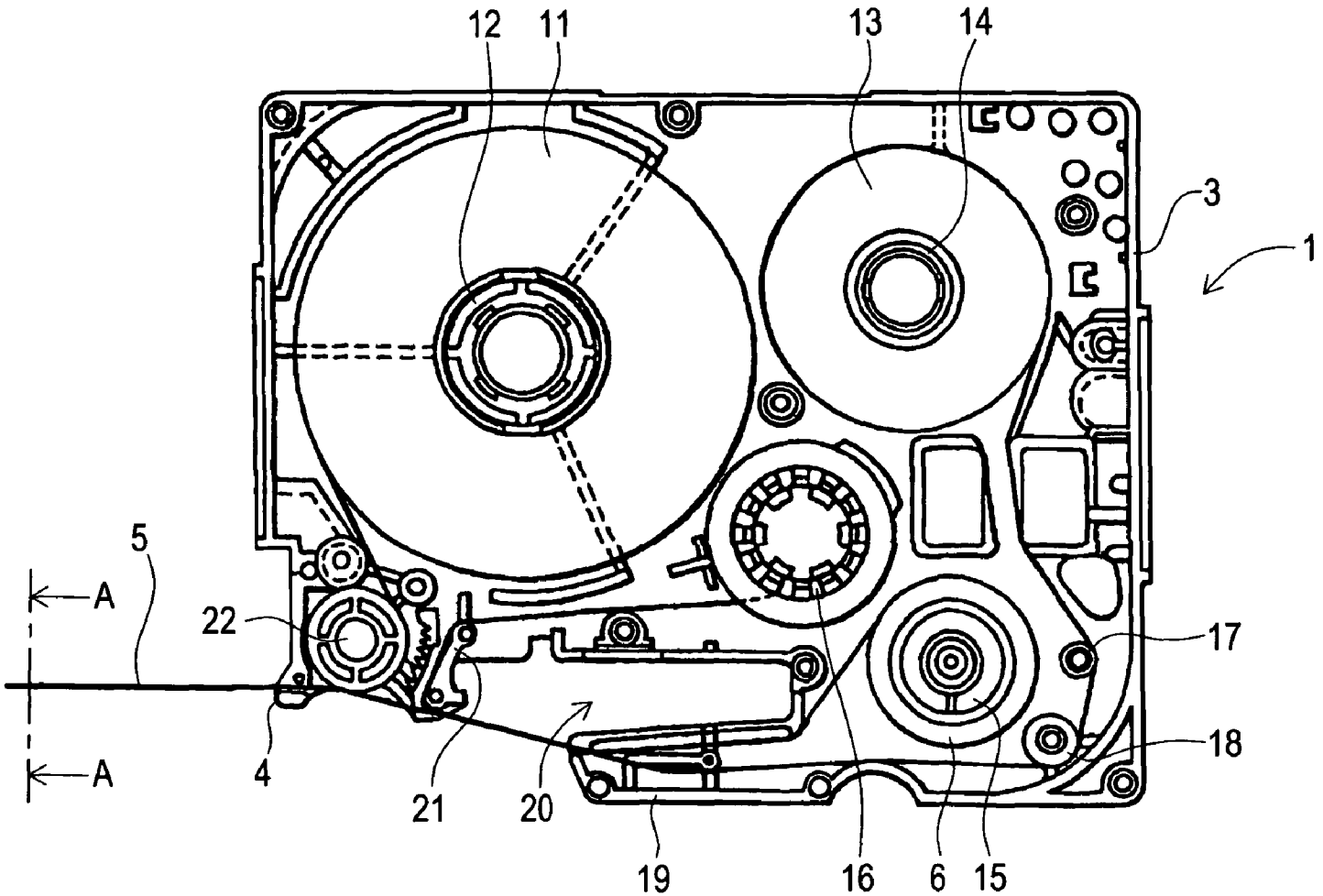
FIG. 3 is a plan view of the print cassette, from which an upper cassette case is removed.

FIG. 3 is a plan view of the print cassette 1 from which the upper cassette case 2 (see FIG. 2) is removed. As shown in FIG. 3, a tape spool 12 on which an adhesive tape 11 is wound, a film spool 14 on which an application tape 13 is wound, a ribbon supply spool 15 on which the ink ribbon 6 is wound, and a ribbon take-up spool 16 are provided on the lower cassette case 3 of the print cassette 1, being rotatable with cooperation of respective spool support members (not shown) formed on the upper cassette case 2 (see FIG. 2).

The application tape 13 includes a film tape made of a urethane sheet. An inside surface of the application tape 13 wound on the film spool 14 will be a printing surface. Therefore, the application tape 13 wound on the film spool 14 is guided to an arm part 19 formed on the lower cassette case 3, via a guide pin 17 provided on the lower cassette case 3 in an upright position and a rotatable guide roller 18. The application tape 13 is further guided out of the arm part 19, being exposed outside a thermal head attachment space 20. After that, the application tape 13 is discharged from the tape cassette 1 through the tape discharging port 4, via a guide member 21 and a feed roller 22.

The ink ribbon 6 is wound on the ribbon supply spool 15 with an ink-coated surface facing in an inward direction. The ink ribbon 6 wound on the ribbon supply spool 15 in this way is exposed out of the arm part 19 outside the thermal head attachment space 20. The ink ribbon 6 is further guided while the ink-coated surface and the printing surface of the application tape 13 are overlapped each other. After that, the ink ribbon 6 is guided along an exterior of the guide member 21, thereby getting separated from the printing surface of the application tape 13. Finally, the ink ribbon 6 is taken up by the ribbon take-up spool 16.

The adhesive tape 11 has an adhesive layer coating a release sheet. The adhesive tape 11 is wound on the tape spool 12 with the release sheet side outside. The adhesive tape 11 wound on the tape spool 12 in this way is guided by the feed roller 22 while the adhesive-coated surface of the adhesive layer and the printing surface of the application tape 13 are overlapped each other. As a result, the adhesive tape 11 is adhered to the application tape 13, and discharged outside the print cassette 1 through the tape discharging port 4.

Figure 4:
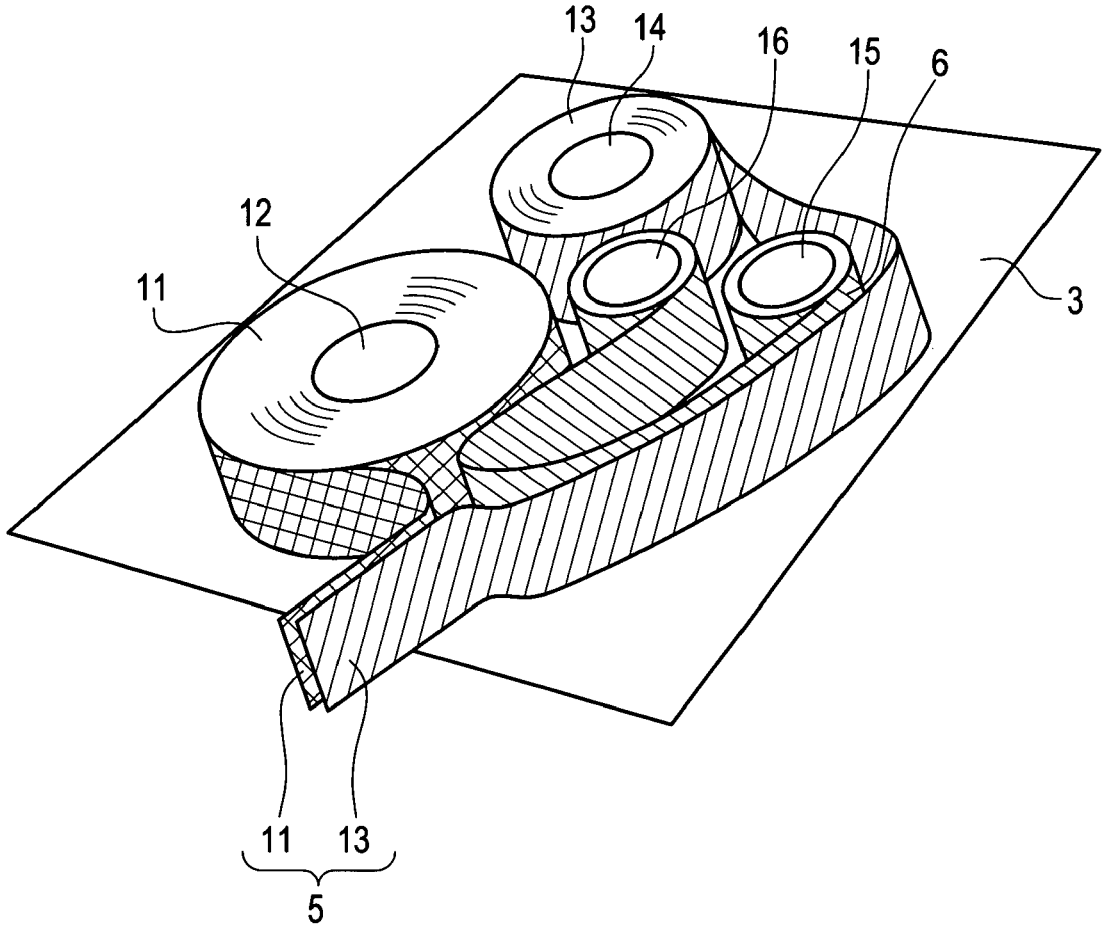
FIG. 4 is a schematic view of a process in which an adhesive tape, an application tape and an ink ribbon are guided on a lower cassette case.

Accordingly, the lettering tape 5, which is composed of the application tape 13 and the adhesive tape 11, is discharged from the print cassette 1 through the tape discharging port 4. FIG. 4 is a schematic view showing a process of the adhesive tape 11, the application tape 13 and the ink ribbon 6 being guided on the lower cassette case 3 as described above.

Figure 1:
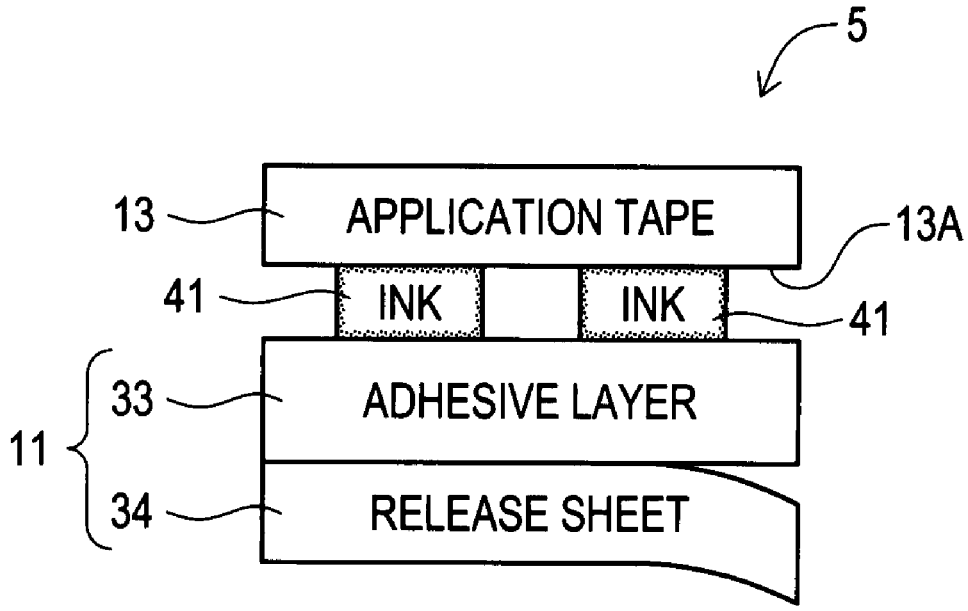
FIG. 1 is a sectional view of a lettering tape taken along a line A-A in FIG. 3.

FIG. 1 is a cross-sectional view of the lettering tape 5 taken along a line A-A shown in FIG. 3. As shown in FIG. 1, the lettering tape 5 is composed of the application tape 13 and the adhesive tape 11. The adhesive tape 11 comprises an adhesive layer 33 coating a release sheet 34. A printing surface 13A of the application tape 13 to which ink 41 is thermally transferred from the ink ribbon 6. The printing surface 13A of the application tape 13 with the ink 41 and the adhesive layer 33 are overlapped each other, so that the application tape 13 is stuck to the adhesive tape 11 to compose the lettering tape 5.

Figure 5:
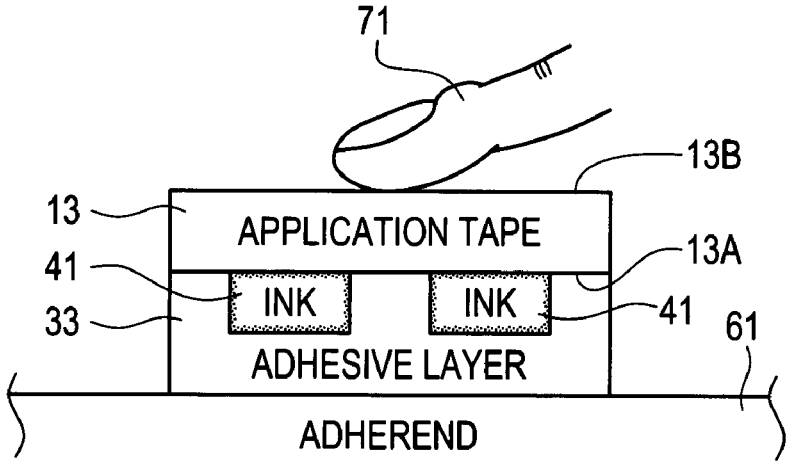
FIG. 5 is a sectional view of the lettering tape when ink thereon is retransferred to an adherend.
Figure 6:
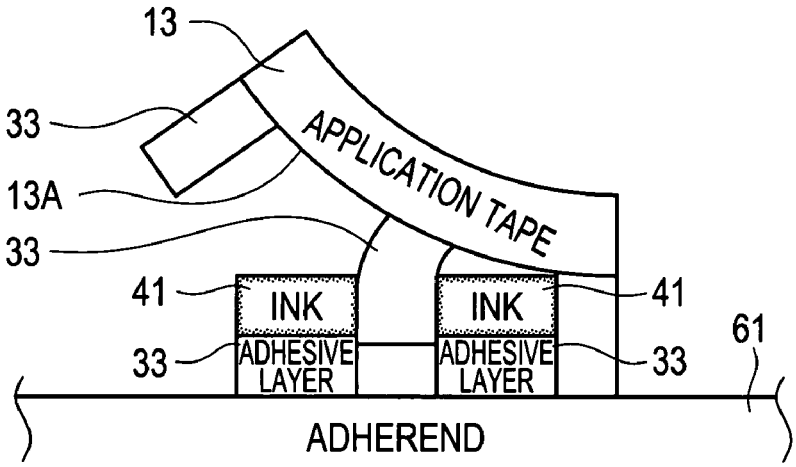
FIG. 6 is a sectional view of the lettering tape when the ink thereon is retransferred to the adherend.
Figure 7:
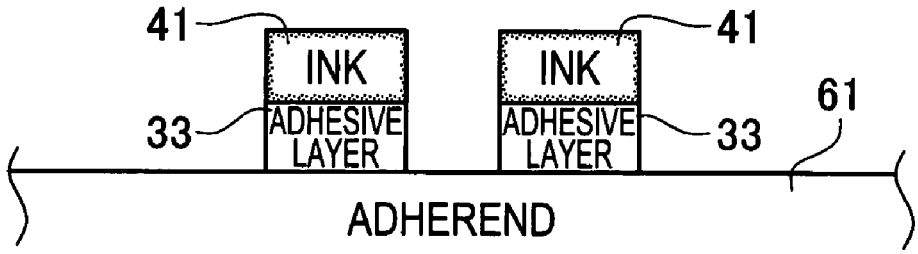
FIG. 7 is a sectional view of the lettering tape when the ink thereon is retransferred to the adherend.

Further, the lettering tape 5, from which the release sheet 34 is removed so that the adhesive layer 33 is exposed, can be adhered to an adherend. Next, as shown in FIG. 5, a whole surface of the application tape 13 is pressed by a finger 71 over a top surface 13B of the application tape 13 toward an adherend 61, so that not only the ink 41 on the printing surface 13A of the application tape 13 but also the printing surface 13A is strictly adhered to the adhesive layer 33 on the adherend 61. After that, the application tape 13 is slowly removed, and then as shown in FIG. 6, only the adhesive between the printing surface 13A of the application tape 13 and the adherend 61 out of the adhesive forming the adhesive layer 33 is removed from the adherend 61 with the application tape 13. As a result of this, as shown in FIG. 7, only the adhesive between the ink 41 and the adherend 61 out of the adhesive forming the adhesive layer 33 remains on the adherend 61. Thus, the ink 41 which is thermally transferred to the printing surface 13A of the application tape 13 can be retransferred to the adherend 61.

In order that the ink 41 on the printing surface 13A of the application tape 13 is retransferred to the adherend 61 as described above, the adhesive making up the adhesive layer 33 includes an adhesive composition made of aqueous acrylate dispersions as main material, for instance, an adhesive corresponding to Primal PS83D by identification: Rohm & Haas, Germany. With this adhesive, even in the case where the adherend 61 is made of resin or glass, the lettering tape 5 can be adhered thereto, so that the ink 41 thermally transferred to the printing surface 13A of the application tape 13 can be retransferred to the adherend 61.

Incidentally, the print cassette 1 is set in a cassette mount of a tape printer (not shown) to produce the lettering tape 5. In the cassette mount of the tape printer, there is provided a cutter device (not shown) having a cutter to cut the lettering tape 5 discharged from the print cassette 1 through the tape discharging port 4. The structures of the print cassette 1 as explained with reference to FIG. 2 and other figures and the tape printer in which the print cassette 1 is installed to produce the lettering tape 5 have been publicly known as well as the structures of a conventional tape printer to print characters and the like on a print tape and a conventional tape cassette installed therein and storing the print tape, so the detailed explanation of the process for producing the lettering tape 5 with the print cassette 1 and the tape printer is omitted.

Figure 8:
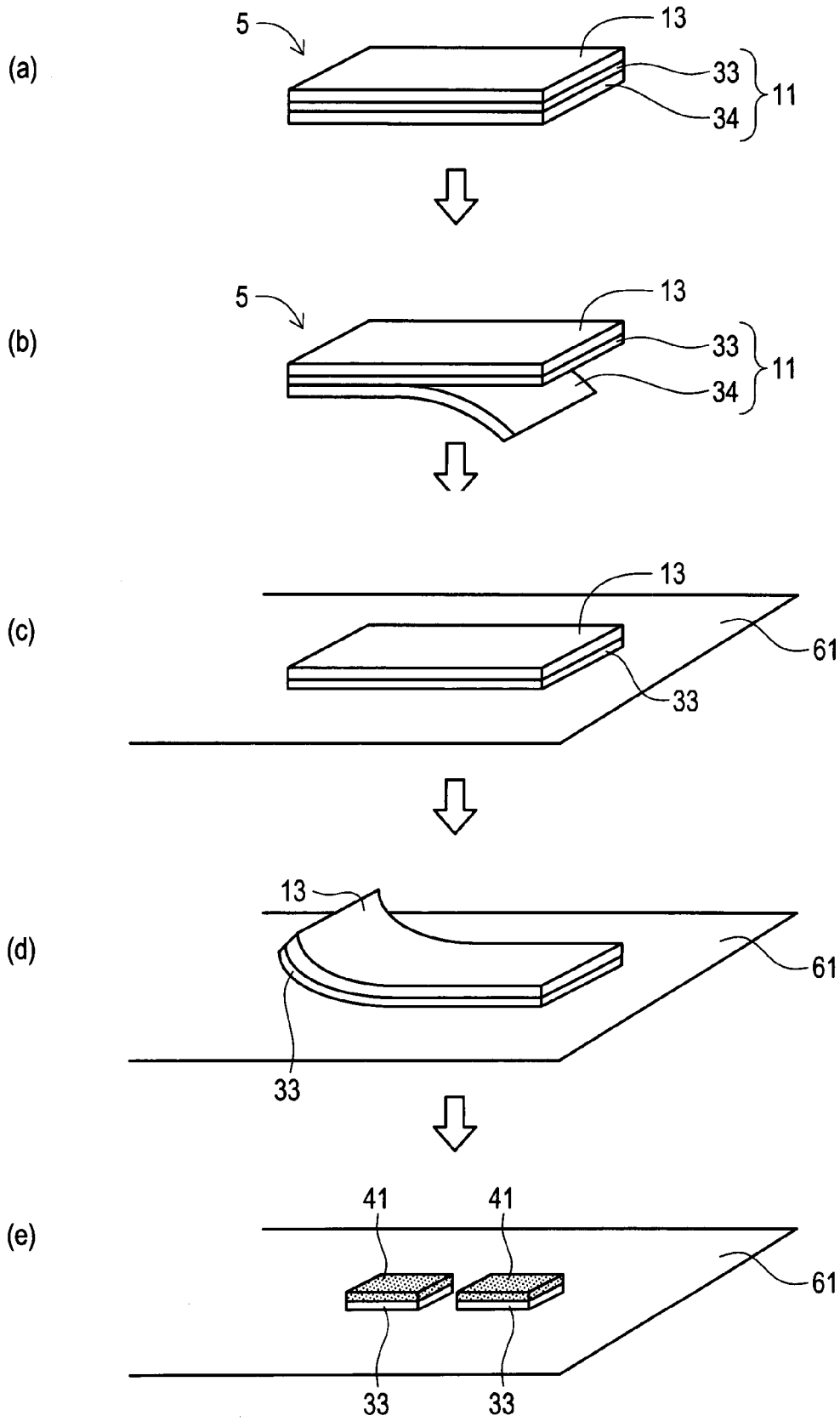
FIG. 8 shows how to use the lettering tape.

Next, the way of using the lettering tape 5 will be explained with reference to FIG. 8. The lettering tape 5 is discharged from the print cassette 1 through the tape discharging port 4 of this exemplary embodiment, the print cassette 1 being set in the cassette mount of the tape printer (not shown). The lettering tape 5 is cut with the cutter device of the tape printer (not shown) to be a strip-formed lettering tape 5 composed of the adhesive tape 11 (the adhesive layer 33 and the release sheet 34) and the application tape 13 as shown in FIG. 8(*a*). As shown in FIG. 8(*b*), the release sheet 34 of the adhesive tape 11 is removed, so that the adhesive layer 33 of the adhesive tape 11 is exposed. Further, the adhesive layer 33 of the adhesive tape 11 is stuck to the adherend 61 as shown in FIG. 8(*c*).

The whole surface of the application tape 13 is pressed by fingers and the like, and then slowly removed from the adherend 61 as shown in FIG. 8(*d*). Accordingly, as shown in FIG. 8(*e*), the ink 41 is stuck to the adherend 61 with the adhesive layer 33. The ink 41 has been thermally transferred from the ink ribbon 6 (see FIG. 3 and other figures) to the printing surface 13A (see FIG. 1 and other figures) of the application tape 13 with the tape printer (not shown).

Figure 9:
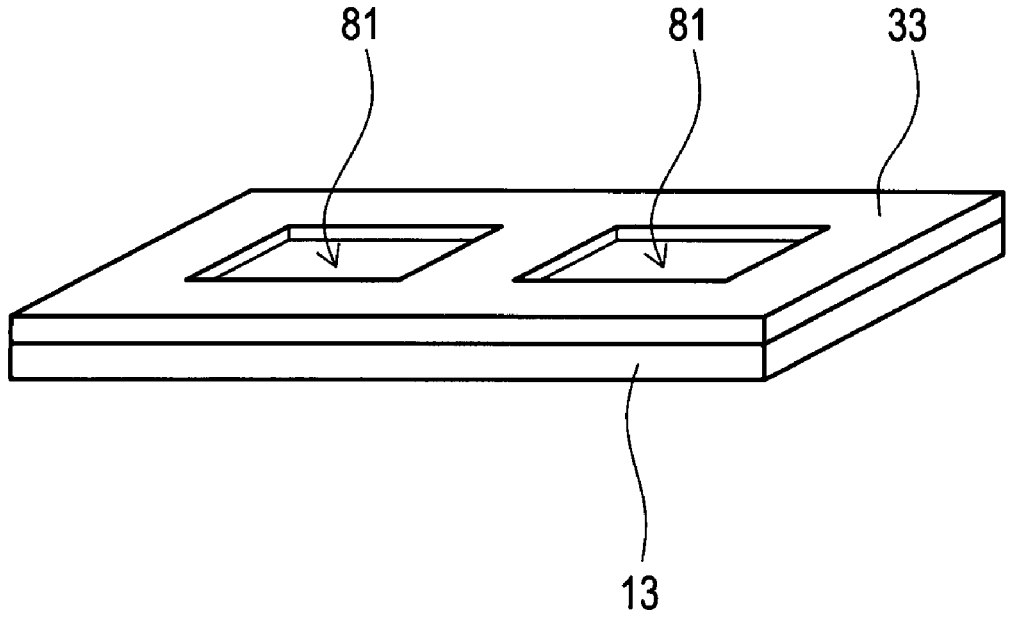
FIG. 9 shows the application tape which is removed from the adherend.

It is noted that the adhesive layer 33 is still stuck to the application tape 13 which has been removed from the adherend 61 as shown in FIG. 9. Herein, the adhesive layer 33 stuck to the application tape 13 is formed with a concave part 81 where the printing surface 13A (see FIG. 1 and other figures) of the application tape 13 is exposed. The concave part 81 is formed since the ink 41 thermally transferred to the printing surface 13A (see FIG. 1 and other figures) of the application tape 13 is stuck to the adherend 61, thereby hollowing the adhesive layer 33.

As described in detail above, the print cassette 1 of the exemplary embodiment is set in the cassette mount of the tape printer (not shown) to produce the lettering tape 5 which is discharged from the tape printer (not shown).

The lettering tape 5 discharged from the printer (not shown) is cut by the cutter device of the tape printer (not shown), and then the release sheet 34 is removed from the adhesive tape 11 stuck to the application tape 13, thereby exposing the adhesive layer 33 (see FIG. 8(*b*)). The exposed adhesive layer 33 is stuck to the adherend 61, and then the whole top surface 13B of the application tape 13 is pressed by the finger 71 and the like toward the adherend 61, so that not only the ink 41 thermally transferred to the printing surface 13A of the application tape 13 but also the printing surface 13A is strictly adhered to the adhesive layer 33 on the adherend 61 (FIGS. 5, 8C). After that, the application tape 13 is slowly removed from the adhesive tape 11 (FIG. 8(*d*)), and then only the adhesive between the printing surface 13A of the application tape 13 and the adherend 61 out of the adhesive layer 33 is removed from the adherend 61 with the application tape 13 as shown in FIG. 6. On the other hand, only the adhesive between the ink 41 thermally transferred to the printing surface 13A of the application tape 13 and the adherend 61 out of the adhesive layer 33 remains on the adherend 61 (see FIG. 8(*e*)). Thus, the ink 41 which is thermally transferred to the printing surface 13A of the application tape 13 can be retransferred to the adherend 61.

Accordingly, the print cassette 1 of the exemplary embodiment being set in the cassette mount of the tape printer (not shown) can produce the lettering tape 5 which can be retransferred to the adherend 61 by the pressure of the finger 71 and the like.

Especially, the lettering tape 5 is stuck to the adherend 61 with the adhesive of the adhesive layer 33 not including the base material, thereby being able to be stuck to a curved surface and the like of the adherend 61.

The disclosure may be embodied in other specific forms without departing from the essential characteristics thereof.

For instance, the print cassette 1 of this exemplary embodiment may be provided with multiple types of the ink ribbons 6 in different colors so that the print cassette 1 of the ink ribbon 6 in the desired color is selectively installed in the cassette mount of the tape printer (not shown). Thus, the lettering tape 5 can be produced with the ink of the desired color thermally transferred thereto.

Figure 10:
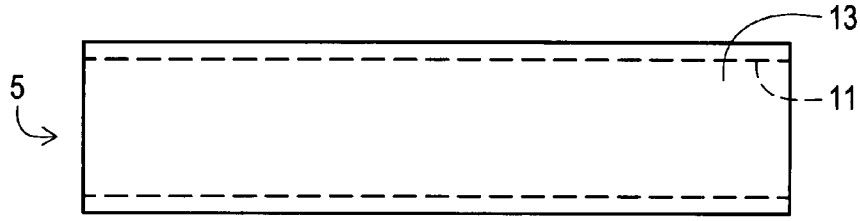
FIG. 10 is a plan view showing a lettering tape of another exemplary embodiment.
Figure 11:
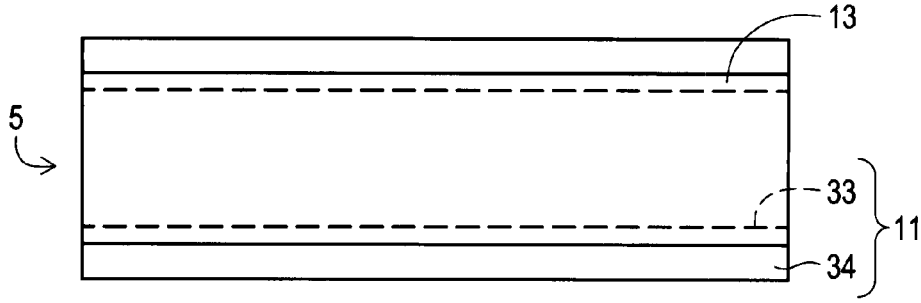
FIG. 11 is a plan view showing a lettering tape of another exemplary embodiment.
Figure 12:
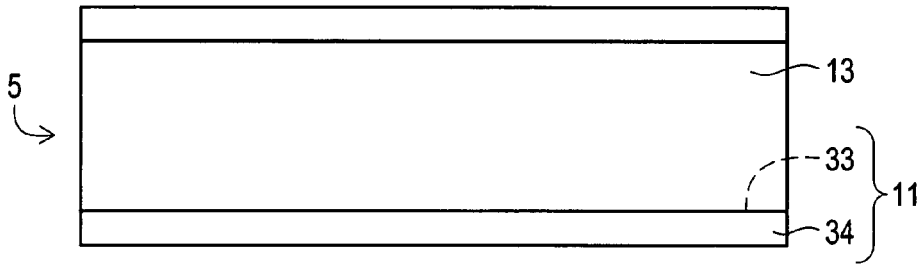
FIG. 12 is a plan view showing a lettering tape of another exemplary embodiment.

Further, with regard to the lettering tape 5 which is produced in the tape printer (not shown) by using the print cassette 1 of this exemplary embodiment, for instance, the application tape 13 may have a width wider than that of the adhesive tape 11 as shown in FIG. 10. Alternatively, the application tape 13 may have a width narrower than that of the adhesive tape 11, as shown in a plan view of FIG. 12. In this case, the adhesive layer 33 of the adhesive tape 11 may be narrower than the application tape 13 as shown in a plan view of FIG. 11. In both cases, the application tape 13 and (the release sheet 34 of) the adhesive tape 11 are different in width, which makes it easy to distinguish them and also to unstuck the application tape 13 and the adhesive tape 11.

Figure 13:
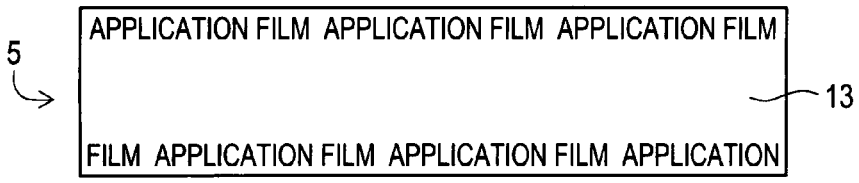
FIG. 13 is a plan view showing a lettering tape of another exemplary embodiment.

As shown in a plan view of FIG. 13, even in the lettering tape 5 having the application tape 13 as wide as the adhesive tape 11, the presence of the application tape 13 can be emphasized with prints such as characters and patterns representing the application tape 13 preliminarily printed on the top surface 13B (see FIG. 5) of the application tape 13, thereby facilitating a work to unstuck the application tape 13. In addition, if the top and bottom of the lettering tape 5 can be distinguished by the characters and patterns preliminarily printed on the application tape 13, the lettering tape 5 is allowed to adhered readily to the adherend 61 (see FIG. 8 and other figures).

Accordingly, this disclosure having the characteristic like this is the print cassette disclosed in any one of claims 1 to 20, having the prints preliminarily performed on the application tape.

Figure 14:
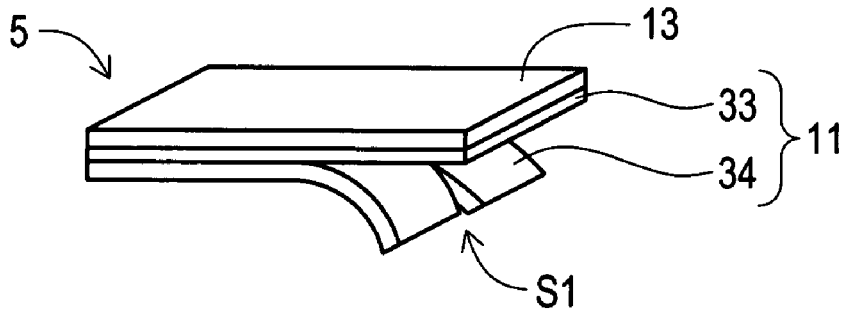
FIG. 14 is a perspective view showing a lettering tape of another exemplary embodiment.

Further, as shown in a perspective view of FIG. 14, the lettering tape 5 having the adhesive tape 11 where a half cut S1 is preliminarily provided on the release sheet 34 can offer the convenience when the release sheet 34 of the adhesive tape 11 is removed.

In the lettering tape 5, which is produced in the tape printer (not shown) by using the print cassette 1 of this exemplary embodiment, the application tape 13 may be a transparent and colorless tape or a colored and transparent tape. In the case of the transparent and colorless application tape 13, this allows the ink 41 thermally transferred to the printing surface 13A (see FIG. 1) of the application tape 13 to be visually identified therethrough, so that the top and bottom of the lettering tape 5 can be distinguished easily, thereby facilitating a work to stick the lettering tape 5 to the adherend 61. On the other hand, the colored and transparent application tape 13 allows not only the ink 41 thermally transferred to the printing surface 13A (see FIG. 1) of the application tape 13 but also the presence of the application tape 13 itself to be identified visually. This can facilitate a work to stick the lettering tape 5 to the adherend 61 and a work to unstick the application tape 13.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. A print cassette capable of being installed in a printer, comprising an adhesive tape, an ink ribbon and an application tape inside a cassette case, wherein the adhesive tape, the ink ribbon and the application tape are wound respectively inside the cassette case, and the application tape comprises a printing surface to which ink of the ink ribbon is thermally transferred, and the adhesive tape comprises a release sheet and an adhesive layer, and the adhesive layer is formed with an adhesive coating a first side of the release sheet, and the release sheet is removable from the adhesive, and the adhesive is removable together with the application tape once the side of the adhesive layer where the release sheet was removed is adhered to an adherend except for an area of the adhesive underneath where ink is thermally transferred to the application tape, and for the area where the ink is thermally transferred to the application tape, the adhesive area remains adhered to the adherend and to ink when application tape is removed.

2. The print cassette according to claim 1, wherein the adhesive tape and the application tape are different in width.

3. The print cassette according to claim 2, wherein a half cut is preliminary provided on one of the application tape and the release sheet.

4. The print cassette according to claim 3, wherein the application tape is transparent.

5. The print cassette according to claim 4, wherein the application tape is colored.

6. The print cassette according to claim 2, wherein the application tape is transparent.

7. The print cassette according to claim 1, wherein a half cut is preliminary provided on one of the application tape and the release sheet.

8. The print cassette according to claim 7, wherein the application tape is transparent.

9. The print cassette according to claim 1, wherein the application tape is transparent.

10. A transfer lettering tape comprising an adhesive tape and an application tape, wherein the application tape comprises a printing surface to which ink can be thermally transferred, and the adhesive tape comprises a release sheet and an adhesive layer, and the adhesive layer is formed with an adhesive coating a first side of the release sheet, and the transfer lettering tape is composed of the application tape to which the ink has been thermally transferred and the release sheet of which the first side is stuck to the printing surface of the application tape with the adhesive, and the release sheet is removable from the adhesive, and the adhesive is removable together with the application tape once the side of the adhesive layer where the release sheet was removed is adhered to an adherend except for an area of the adhesive underneath where ink is thermally transferred to the application tape, and for the area where the ink is thermally transferred to the application, the adhesive area remains adhered to the adherend and to ink when application tape is removed.

11. The transfer lettering tape according to claim 10, wherein the adhesive tape and the application tape are different in width.

12. The transfer lettering tape according to claim 11, wherein a half cut is preliminary provided on one of the application tape and the release sheet.

13. The transfer lettering tape according to claim 12, wherein the application tape is transparent.

14. The transfer lettering tape according to claim 13, wherein the application tape is colored.

15. The transfer lettering tape according to claim 11, wherein the application tape is transparent.

16. The transfer lettering tape according to claim 10, wherein a half cut is preliminary provided on one of the application tape and the release sheet.

17. The transfer lettering tape according to claim 16, wherein the application tape is transparent.

18. The transfer lettering tape according to claim 10, wherein the application tape is transparent.

* * * * *